US009089757B2

(12) United States Patent
O'Donovan

(10) Patent No.: US 9,089,757 B2
(45) Date of Patent: Jul. 28, 2015

(54) GOLF SWING BALL IMPACT TEACHING TOOL

(76) Inventor: Dennis M. O'Donovan, Haymarket, VA (US)

( * ) Notice: Subject to any disclaimer, the term of this patent is extended or adjusted under 35 U.S.C. 154(b) by 504 days.

(21) Appl. No.: 13/453,698

(22) Filed: Apr. 23, 2012

(65) Prior Publication Data

US 2012/0295728 A1 Nov. 22, 2012

Related U.S. Application Data

(60) Provisional application No. 61/487,165, filed on May 17, 2011.

(51) Int. Cl.
*A63B 69/36* (2006.01)
*A63B 71/06* (2006.01)

(52) U.S. Cl.
CPC ..... *A63B 69/3641* (2013.01); *A63B 2069/3629* (2013.01); *A63B 2071/0694* (2013.01)

(58) Field of Classification Search
USPC ..... 473/150, 219, 278, 387, 404, 405, 407, 473/409, 257
See application file for complete search history.

(56) References Cited

U.S. PATENT DOCUMENTS

| | | | | |
|---|---|---|---|---|
| 5,011,153 | A * | 4/1991 | Watkins | 473/236 |
| 5,294,124 | A * | 3/1994 | Florian | 473/267 |
| 5,443,265 | A * | 8/1995 | Wheeler | 473/257 |
| D366,302 | S * | 1/1996 | Marsh et al. | D21/792 |
| 6,036,608 | A * | 3/2000 | Morris | 473/220 |
| D436,639 | S * | 1/2001 | Haliyo | D21/791 |
| 6,840,870 | B1 * | 1/2005 | Froggatte | 473/265 |
| D508,547 | S * | 8/2005 | Llewellyn | D21/791 |
| 7,214,140 | B2 * | 5/2007 | Coombs | 473/278 |
| D632,750 | S * | 2/2011 | Callowhill et al. | D21/791 |
| 7,997,994 | B2 * | 8/2011 | Hensel | 473/257 |
| D692,512 | S * | 10/2013 | Fanfelle | D21/791 |
| 2006/0229137 | A1 * | 10/2006 | McCarthy | 473/251 |
| 2011/0111876 | A1 * | 5/2011 | Hart | 473/257 |
| 2014/0335969 | A1 * | 11/2014 | Ellington | 473/257 |

OTHER PUBLICATIONS

Tourstriker, http://www.tourstriker.com/default.aspx (last visited Apr. 20, 2012). pp. 1-2 of homepage included.
Impact Bag Golf Training Aid, D.W. Quail Golf, http://www.dwquailgolf.com/training/impact_bag.html (last visited Apr. 20, 2012). pp. 1-3 included.

* cited by examiner

*Primary Examiner* — William Pierce
(74) *Attorney, Agent, or Firm* — Dickstein Shapiro LLP

(57) ABSTRACT

A golf teaching tool to provide instant user feedback, while explaining and encouraging proper ball impact. The golf teaching tool includes a rectangular plate with a cutout section. The golf teaching tool is placed on a playing surface with the cutout section pointed towards an intended target. A golf ball is placed on the playing surface within the cutout section and subsequently hit. Sound, impact, ball flight and movement of the golf teaching tool due to the golf club hitting the golf teaching tool, or no movement of the golf teaching tool provide the user immediate feedback regarding the correctness of the swing.

12 Claims, 8 Drawing Sheets

GOLF SWING BALL IMPACT TEACHING TOOL

RELATED APPLICATION(S)

The present application claims priority to provisional application 61/487,165 filed May 17, 2011, which is hereby incorporated by reference in its entirety.

FIELD

The present disclosure relates to a golf teaching tool and, more particularly, to a golf teaching tool, which promotes proper ball impact by providing instant feedback to a user when a proper, or an improper impact occurs.

BACKGROUND

According to a report by the National Golf Foundation in 2009, there are 28.6 million golfers in the United States. An overwhelming majority of these golfers do not understand the basic concept of correct club to ball impact. This causes them to incorrectly hit shots. Mishit shots include both fat and thin shots. A fat shot occurs when the golf club strikes the ground prior to striking the golf ball. A fat shot greatly reduces the speed of the club, which reduces the speed of the ball and in turn decreases the distance the ball will travel. A thin shot occurs when the leading edge of the golf club strikes the ball at or near its equator, resulting in an uncontrollable line drive. Both fat and thin shots are caused by improper ball impact meaning the bottom of the swing arc is located incorrectly in relation to the golf ball. Mishit shots also include those shots where the toe or heel of the golf club, rather than the center of the golf club face, impacts the ball. These shots are caused by improper positioning of the club relative to the ball at impact.

Club to ball impact also determines the ball trajectory or type of shot that results. Many golfers struggle to hit straight shots and often experience shots that slice or hook. For a right handed golfer, a slice is a shot that curves to the right while a hook is a shot that curves to the left. Different factors contribute to slices and hooks but the primary factor is the angle of the club face relative to the club path at the point of impact. If the club face is square to the club path, the ball will generally fly straight whereas a club face that is open relative to the club path, inclined to the right, results in a slice and a club face that is closed relative to the path, inclined to the left, results in a hook.

While the terms slice and hook are commonly used to describe errant or misdirected shots, the terms fade and draw are used to describe less severe slices and hooks. A fade is a less severe version of a slice, and a draw is a less severe version of a hook. Similar to a slice, a fade curves to the right for a right handed player and like a hook, a draw curves to the left. Any of these shots may be played intentionally to negotiate obstacles or curves in the line of play.

The priority for every player should be correct solid ball impact. Most players do not understand what should happen between the club and ball at impact, so they never work on it. They waste time practicing things that they have read, or heard, that have little or no bearing on how well they play. If the player does not understand the details of how the club should impact the ball the other little details simply will not matter. Most players are worried about the details of swing positions and ignore the foundation of a correct impact between club and ball. Understanding and learning how to create proper ball impact will improve a player's golf game. Ultimately it is proper impact that produces good shots. Only once a player understands the fundamentals of proper ball impact can he/she then fine tune the details in order to consistently create proper ball impact.

Proper ball impact for most shots means striking the ball on the down stroke before the club reaches the bottom of the swing arc. In other words, the club head is still descending when the ball is struck and any divot or ground contact happens in front (on the target side) of the ball. Hitting the ball prior to arriving at the lowest point of the swing arc results in more consistent contact, lower and more penetrating ball flight, increased ball compression, and higher ball speed, which all lead to increased distance. Understanding and creating proper ball impact produces better shots by eliminating mishit shots, such as fat and thin shots.

There are opposing views on whether some shots, such as drives and putts, should be struck on the downswing, upswing, or level part of the arc, but for most shots downswing impact is preferred. For example, computer data shows that the average PGA Tour player strikes down 1.9 degrees with his driver while the average LPGA Tour player strikes up 3.0 degrees with her driver. On average, when playing shots from turf, PGA Tour players create a bottom of the swing that is 3"-4" in front of the golf ball.

It would be beneficial to have an inexpensive device that helps players understand and achieve proper ball impact.

SUMMARY

The present disclosure provides a golf teaching tool that promotes proper ball impact by providing instant feedback.

The golf teaching tool of the present disclosure encourages proper ball impact by providing instant feedback to the user when proper or improper ball contact has occurred. The golf teaching tool of the present disclosure helps the user understand where the bottom of the swing arc should occur relative to the ball position. The golf teaching tool of the present disclosure also helps the user understand proper club face/club path alignment to minimize slices and hooks. Additionally, the golf teaching tool of the present disclosure provides instruction on club face/club path alignment and aiming to hit controlled fade and draw shots. Overall the device helps the player understand and master proper ball impact fundamentals which will result in improved shot quality (distance and direction), consistency and lower scores.

In one form, the present disclosure provides a golf teaching tool including a rectangular shaped flat surface having a cutout defined therein, the cutout defining a first side section and a second side section which are connected to one another by a rear section. The first and second side sections each include first, second and third sets of markings and each of the first, second and third sets of markings include first, second and third lines. Each pair of the first, second and third lines indicates an alignment of a golf club head for one of a fade shot, a straight shot or a draw shot. At least one of the first, second and third sets of markings is labeled to indicate which of a fade shot, a straight shot or a draw shot each of the first, second and third pairs of lines corresponds. Each of the first, second and third sets of markings is indicative of a difficulty level, a range of clubs, or both. The rear section includes a fourth set of markings; the fourth set of markings includes first, second and third arrows. Each of the first, second and third arrows indicates the alignment of the device for one of a fade shot, a straight shot or a draw shot and each of the first, second and third arrows is labeled to indicate the corresponding shot type. The arrow corresponding to a straight shot is additionally labeled to indicate body alignment.

In another form, the present disclosure provides a golf training method which includes placing a golf teaching tool including a cutout section on a playing surface with the cutout section generally facing the intended target. Aligning the golf teaching tool such that an arrow on the golf teaching tool corresponding to the preferred shot type points towards the intended target. Positioning a golf ball within the cutout section of the golf teaching tool based on a selected golf club to be used, a desired degree of difficulty, or both. Establishing a golf stance such that a user's body is aligned with an arrow on the golf teaching tool corresponding to a straight shot. Positioning the head of a golf club such that it is aligned with lines on the golf teaching tool corresponding to one of a fade shot, a straight shot or a draw shot. Swinging the golf club such that it hits the ball and the golf teaching tool, the contact of the golf club and the golf teaching tool creating sound and impact and also moving the golf teaching tool. Analyzing the sound, impact and movement of the golf teaching tool to diagnose problems in the swing.

In an additional form, the present disclosure provides a method of providing golf instruction comprising providing a set of instructions to a potential user. Said instructions including how to place a golf teaching tool on a playing surface, how to align the golf teaching tool such that an arrow on the golf teaching tool corresponding to the preferred shot type points towards the intended target, and how to position a golf ball within a cutout section of the golf teaching tool based on either a club to be used, a desired degree of difficulty, or both. Said instructions further including how to establish a golf stance such that a user's body is aligned with an arrow on the golf teaching tool corresponding to a straight shot, how to position the head of a golf club such that it is aligned with lines on the golf teaching tool corresponding to one of a fade shot, a straight shot or a draw shot, how to swing the golf club such that it hits the ball and then turf, and not the golf teaching tool, and how to analyze sound, impact and movement of the golf teaching tool caused by any contact between the teaching tool and golf club in order to diagnose problems in the swing. The provision of the set of instructions includes providing one or more of written instructions, video instructions, and in person instructions.

Further areas of applicability of the present disclosure will become apparent from the detailed description provided hereinafter. It should be understood that the detailed description, including disclosed embodiments and drawings, are merely exemplary in nature intended for purposes of illustration only and are not intended to limit the scope of the invention, its application or use. Thus, variations that do not depart from the gist of the invention are intended to be within the scope of the invention.

DETAILED DESCRIPTION

The present disclosure provides a new golf teaching tool that explains and encourages proper ball impact. The device provides instant feedback via sound, feel and movement informing the user when proper or improper ball impact has occurred. Additionally, the device indicates where the bottom of the swing arc should be relative to the ball position, as well as proper club alignment and aiming for straight, fade, and draw shots. The user's goal is to hit the golf ball without hitting the device as will be discussed in more detail below.

Figure 1:
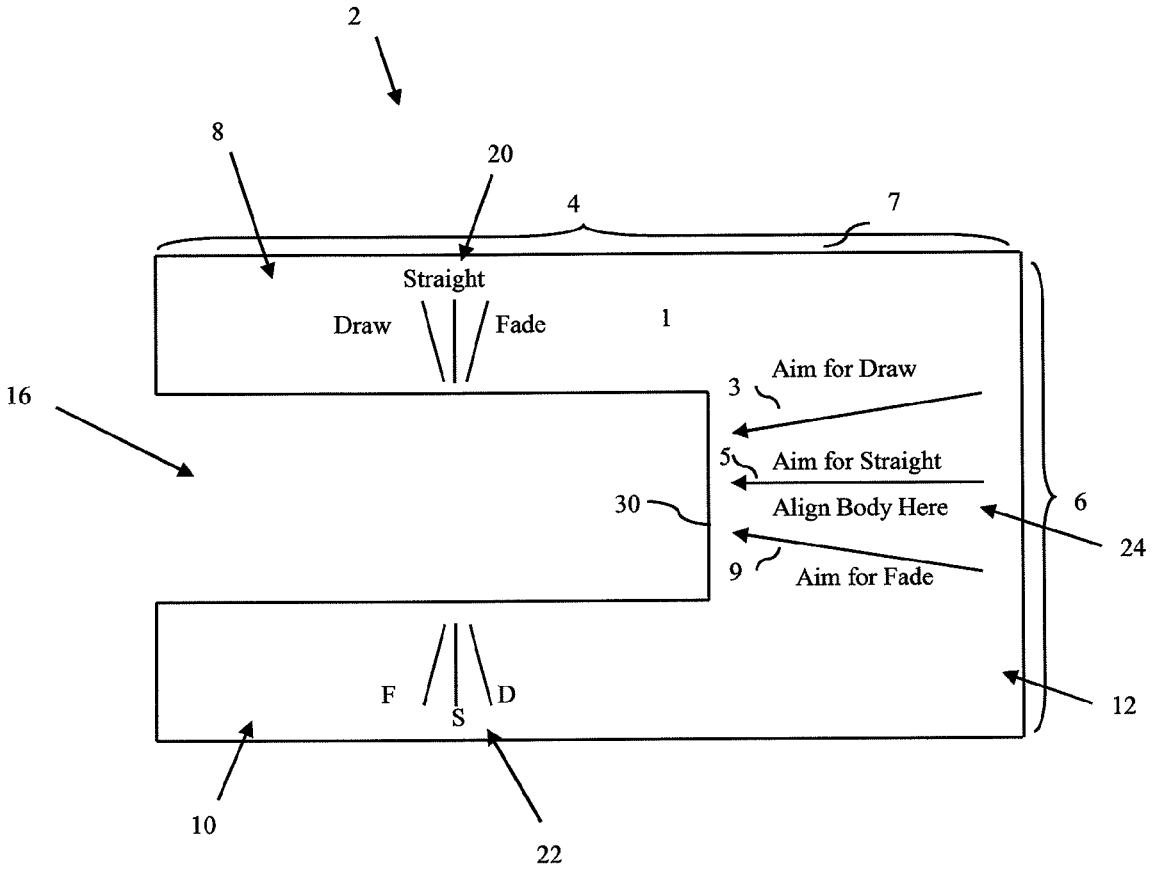
FIG. 1 is a top view of a first embodiment of a device in accordance with the present disclosure.

Referring now to the drawings, FIG. 1 illustrates a first embodiment of the device 2 according to the present disclosure. The device 2 is a rectangular shaped substantially two dimensional frame having a top face portion 1 with a section 16 cut out from one end. The cut-out section 16 defines a right side section 8 and left side section 10 when viewed from rear section 12. Right side section 8 and left side section 10 are connected to one another by rear section 12. The internal edges of cut-out section 16 can be rounded or beveled to provide improved wear behavior resulting from golf clubs impacting the device along the edges of the cut-out section 16.

While the dimensions can vary, the device 2 typically has a thickness along edge 7 between ⅛" and ½", a length 4 between 8" and 24", and a width 6 between 6" and 20". The exterior dimensions can be configured such that the device fits within side pockets on most standard golf bags. Examples include a device that is 10"×14"×¼" with a cutout 5"×10", and a 12"×18"×¼" device with a cutout 5"×12". However, it is to be understood that the width, length and thickness dimensions of device 2 may be of any size.

The device can be constructed from any material but preferably impact resistant plastic, metal or wood. For example, if plastic materials are used, they should provide a desired audible feedback, discussed below, while also having minimal weight and low expense to manufacture. While rigid materials are preferred, it is also possible to construct the device from flexible materials.

FIG. 1 further illustrates three sets of markings 20, 22, and 24 included on the device. The first 20 and second 22 sets of markings indicate club alignment. Each of the first 20 and second 22 sets of markings includes three lines. The lines in first set of markings 20 are labeled with the words "Draw," "Straight," and "Fade." The lines in second set of markings 22 are labeled with the letters "D," "S" and "F." The lines are arranged such that each pair ("Draw" and "D", "Straight" and "S," "Fade" and "F") are at the same angle and may actually lie along the same continuous line. The "Straight" and "S" lines are vertical and indicate proper club alignment for a straight shot. The "Draw" and "D" and "Fade" and "F" lines indicate the proper club alignment for draw and fade shots respectively. The "Straight" and "S" lines also indicate a possible ball position. When the ball is positioned centered between the right side section 8 and left side section 10 in line with the "Straight" and "S" lines, the club will be in-line with the lines for the particular shot being hit. As discussed below, the position of the ball can be varied depending upon the club being used and the desired difficulty level. When the ball is not in line with the "Straight" and "S" lines, but rather spaced apart therefrom by some distance, the club head will be parallel to the lines for the particular shot being hit rather than in line therewith.

The third set of markings 24 includes three arrows. The top arrow 3 is labeled "Aim for Draw" and should be pointed at the intended target when hitting a draw shot. The intended target is the preferred location of the ball after the shot. The middle arrow 5 is horizontal and labeled with both "Aim for Straight" and "Align Body Here." This arrow is pointed at the intended target for straight shots and the user's body should be aligned parallel to this arrow for all shots. The bottom arrow 9 is labeled "Aim for Fade" and should be pointed at the intended target when hitting a fade shot. The specific steps for hitting different shots are discussed in more detail later.

While FIG. 1 shows specific markings and labels therefore, these markings are only exemplary. Other markings and labels may be used to indicate ball placement, bottom of the swing arc, club alignment, aiming and other items without departing from the scope of this disclosure. For instance, rather than using lines as shown, it may be possible to use graphics of a golf club head in different positions to show club head alignment. This is further discussed below relative to FIGS. 6-8. It may also be possible to include either or both of a difficulty range and a club selection bar indicating the relative difficulty and preferred club for a given ball location. The goal of the markings is to provide the user information regarding any of: ball placement, bottom of the swing arc, club head alignment, body alignment, aiming, club type, difficulty, and swing path. Various combinations and styles of markings may provide the user with these pieces of information and are considered within the scope of this disclosure.

Markings 20, 22 in FIG. 1 generally correspond to midrange clubs, such as five through seven irons, and also correspond to an intermediate difficulty level. The embodiment shown in FIG. 1 is not however, limited to any particular clubs or difficulty level and can be used with any type of club. As discussed in more detail below relative to FIG. 2, the ball can be placed any distance from the rear edge 30 of the device in order to vary the difficulty and to adjust for the type of club being used.

Figure 2:
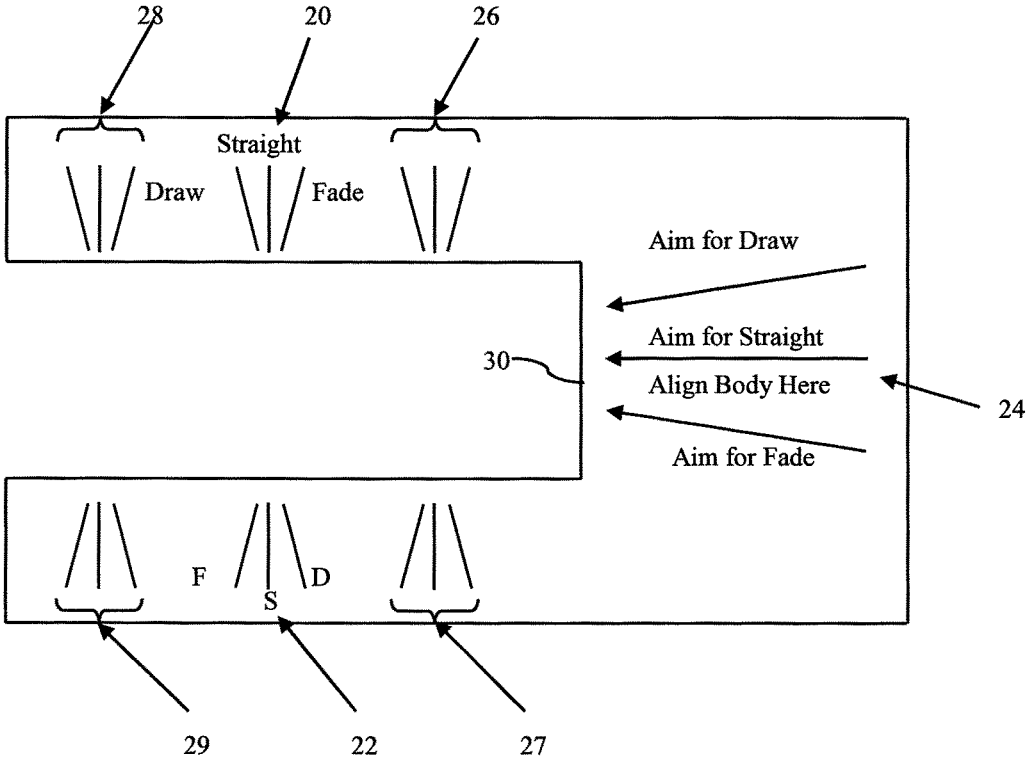
FIG. 2 is a top view of a second embodiment of a device in accordance with the present disclosure.

As seen in FIG. 2, the device may also include additional sets of corresponding markings 26, 27 and 28, 29. These additional markings include at least three lines similar to the first 20 and second 22 sets of markings as shown in FIG. 1. Although not shown, the lines of markings 26, 27, 28, and 29 may be labeled similar to marking 20 and 22 as discussed above. As discussed below, the additional markings 26-29 are indicative of the club in use and the difficulty level.

For instance, markings 26 and 27 correspond to higher numbered clubs such as eight and nine irons along with pitching, sand and lob wedges. These clubs generally create a steeper downswing angle and thus less room is required between the ball, and the rear edge 30 of the device 2. Markings 26 and 27 also correspond to the most difficult ball position as the margin for error is directly related to the space between the ball and the rear edge 30 of the device. Markings 20 and 22 correspond to mid range clubs such as five through seven irons and also correspond to an intermediate difficulty position. Finally markings 28 and 29 correspond to low numbered irons, such as four and below, hybrids and fairway woods. These markings also indicate the easiest position as maximum space is provided between the ball and the device edge 30.

Figure 4:
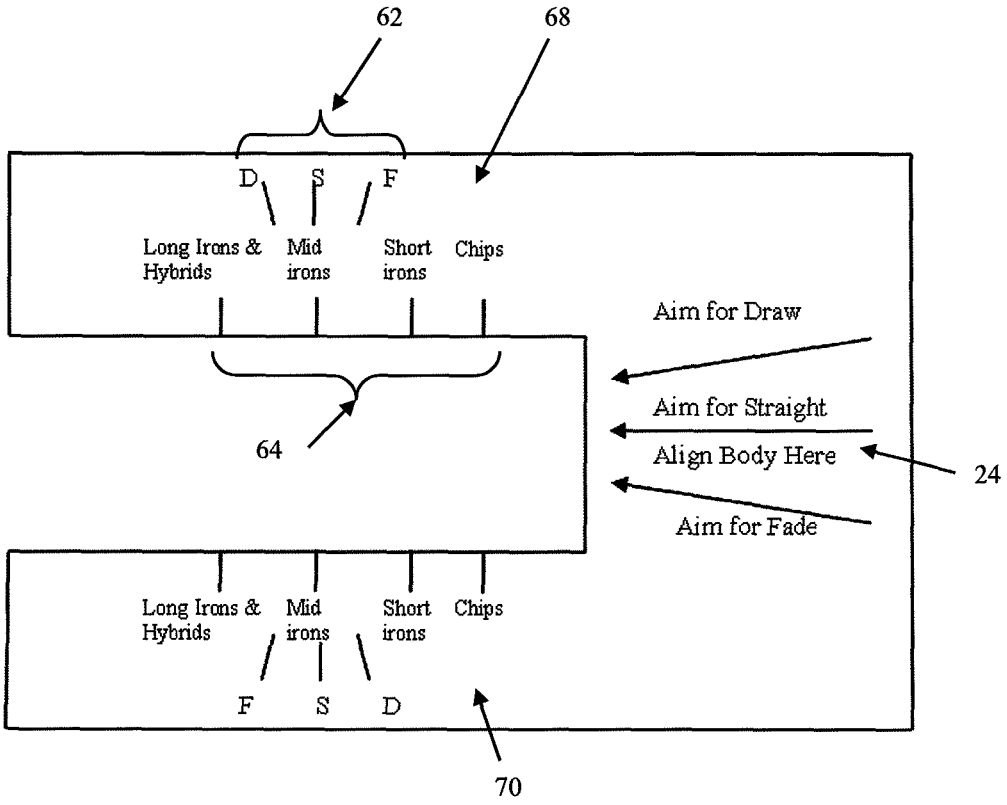
FIG. 4 is a top view of a third embodiment of a device in accordance with the present disclosure.

FIG. 4 shows another embodiment of the invention with a different marking scheme. The embodiment shown in FIG. 4 includes markings 24 which are the same as those discussed relative to FIGS. 1 and 2 above. The markings on the right side section 68 and the left side section 70 differ from those previously discussed. In this embodiment markings 62 include three lines labeled "D", "S", and "F" respectively. These markings are included on both the right side section 68 and the left side section 70 and indicate proper club alignment for draw, straight, and fade shots respectively. Markings 64 are included on both the right side section 68 and the left side section 70 to indicate suggested ball placement based on club type. Markings 64 include four vertical lines on either side of cutout section 16. Each vertical line is accompanied by identifying text indicating a range of clubs or shot type that corresponds to the particular pair of lines. As discussed below, markings 64 help the user choose how far to position the ball from the rear of the device based on the club to be used.

When hitting from the sand of a greenside bunker it is beneficial to use an open clubface as this provides added loft with less roll which helps get the ball out of the sand and keeps it on the green. Furthermore, unlike other shots it is also desirable for the club to hit and enter the sand before it reaches the ball. This has the effect of throwing some sand along with the ball out of bunker and, in conjunction with the open clubface, provides added loft with limited ball speed to lift the ball out of the bunker while keeping it from rolling off the green.

Figure 5:
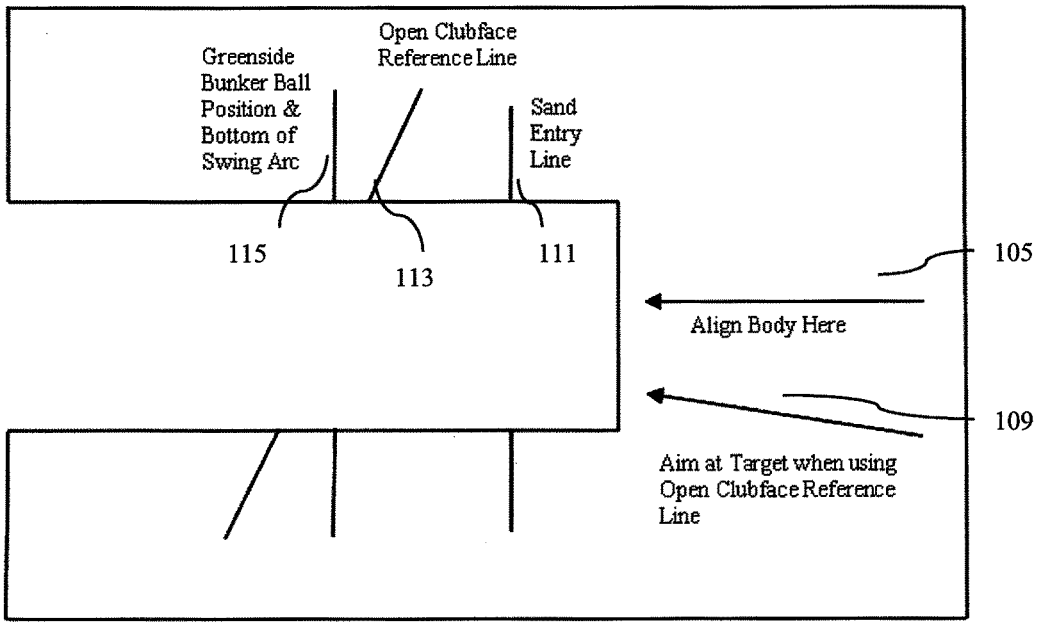
FIG. 5 a top view of a fourth embodiment of a device in accordance with the present disclosure.

FIG. 5 shows an additional embodiment of the invention for use in greenside bunkers. This embodiment includes a first arrow 105 indicating the proper swing path and body alignment. Arrow 109 should be pointed at the intended target when using the open clubface reference line 113. Open clubface reference line 113 shows the proper clubface alignment for hitting bunker shots for a right handed user. Sand entry line 111 shows the point at which the club head should enter the sand. Line 115 indicates both placement of the ball and the bottom of the swing arc. Although shown as a separate device it is also anticipated that such markings could be included with markings shown in FIG. 1, 2, or 4 in a single device.

Although not shown, the bottom of the device in each embodiment has similar markings such that the device can be flipped over for use by left handed users. The markings on the reverse side are generally the same except that the labeling is reversed to be readable by left handed users.

Figure 6:
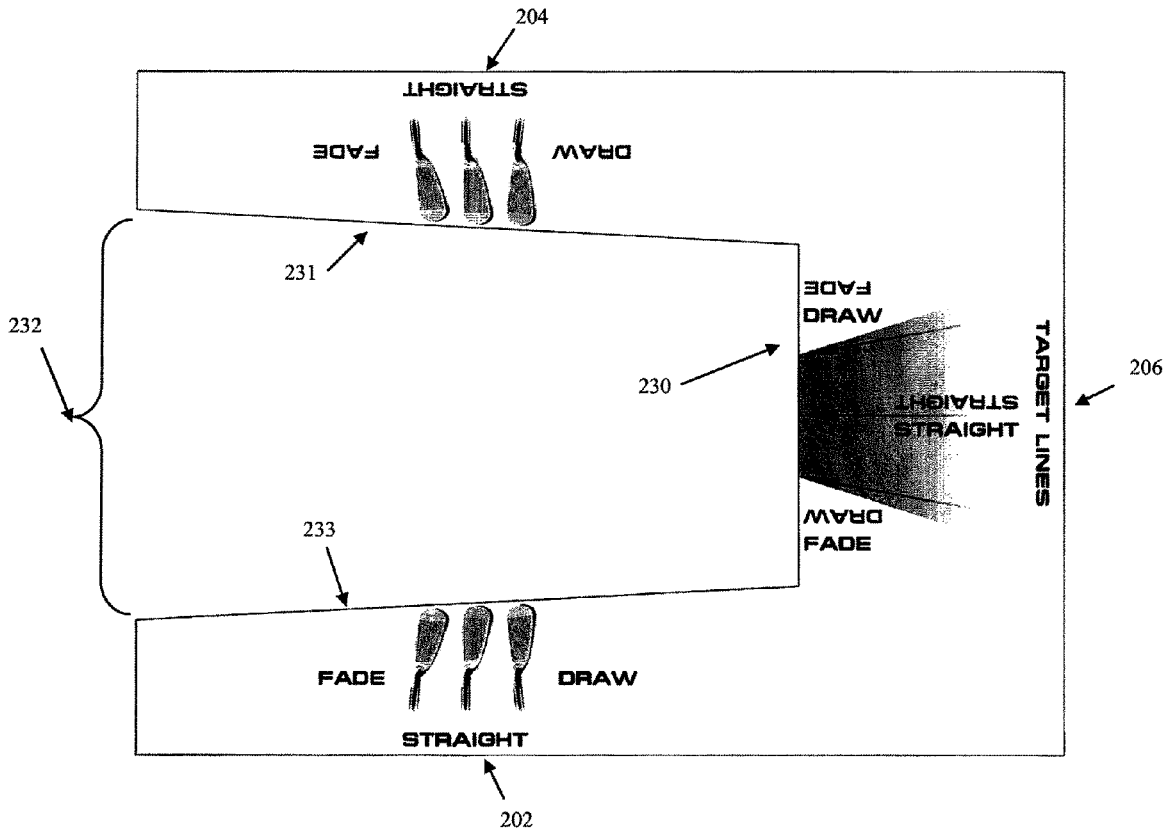
FIG. 6 a top view of a fifth embodiment of a device in accordance with the present disclosure.

FIG. 6 shows an additional embodiment similar to the embodiment shown in FIG. 1. In this embodiment the open end 232 of the cut-out section (similar to 16 in FIG. 1) is longer than the rear edge 230 of the cut-out section such that the edges 231 and 233 of the cut-out section are not parallel to one another. This arrangement allows for some level of side to side swing inaccuracy without resulting in contact between the club head and the device.

FIG. 6 also has modified markings. The first set of markings 202 show three illustrations of club heads and their respective orientations for different types of shots. Markings 202 are used by right handed golfers in aligning their club head for fade, straight, and draw shots. Rather than flipping the device over for use by left handed golfers, as discussed above, the embodiment shown in FIG. 6 includes a second set of markings 204. The second set of markings 204 is a mirror image of the first set of markings 202 and is used by left handed golfers. A third set of markings 206 shows the swing paths for the different types of shots. Labels are included for both right and left handed users. Markings 206 include a gradient background to reinforce the intended swing direction and increasing speed of the club head to the user.

Figure 7:
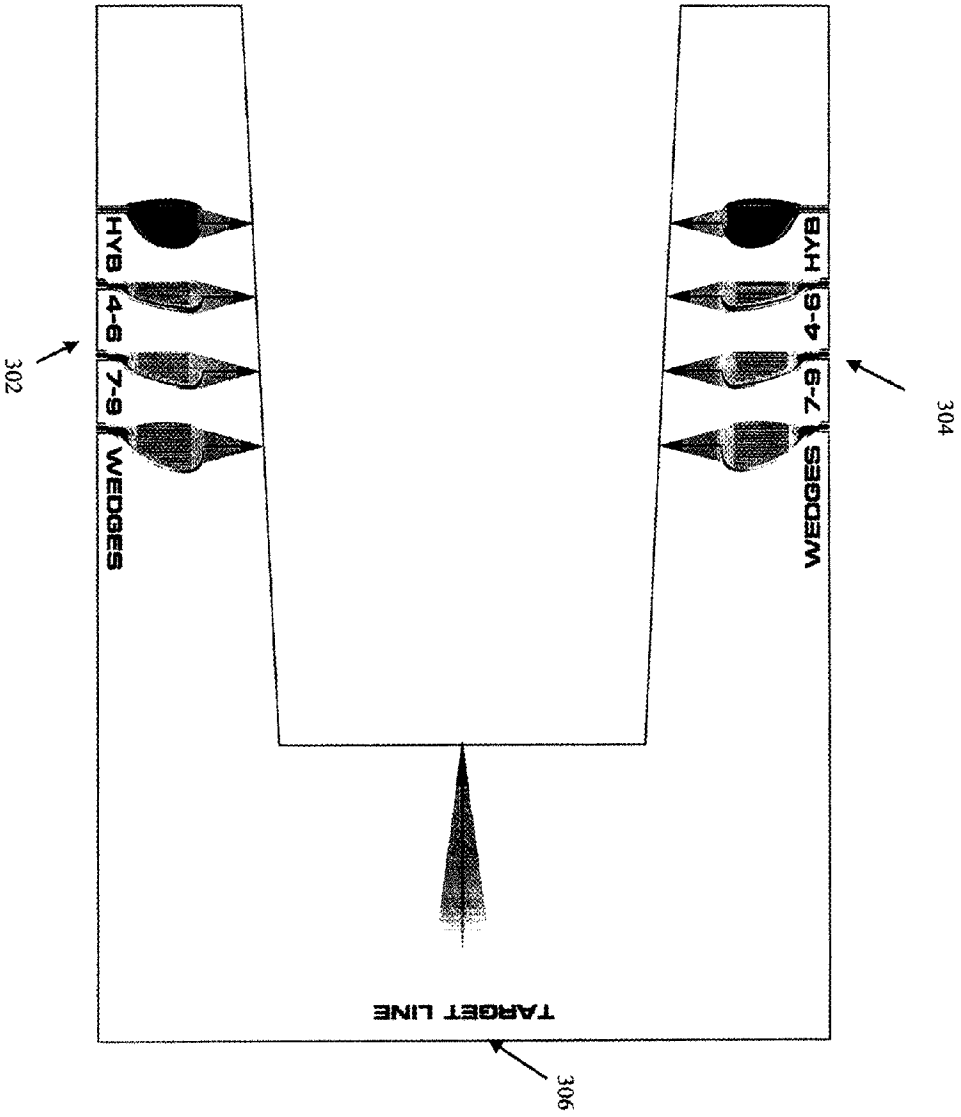
FIG. 7 a top view of a sixth embodiment of a device in accordance with the present disclosure.

FIG. 7 shows an additional embodiment similar to the embodiment shown in FIG. 4. Similar to the embodiment of FIG. 6, the cut-out section has non-parallel sides to allow for some side to side inaccuracy. FIG. 7 includes a first set of markings 302. Markings 302 shows club heads for different club types and indicate suggested ball placement for the various club types. Markings 302 are for use by right handed users. Here again, a second set of markings 304, representing a mirror image of markings 302, is included for use by left handed users. A third set of markings 306, indicates the swing path and direction using an arrow and a gradient background.

Figure 8:
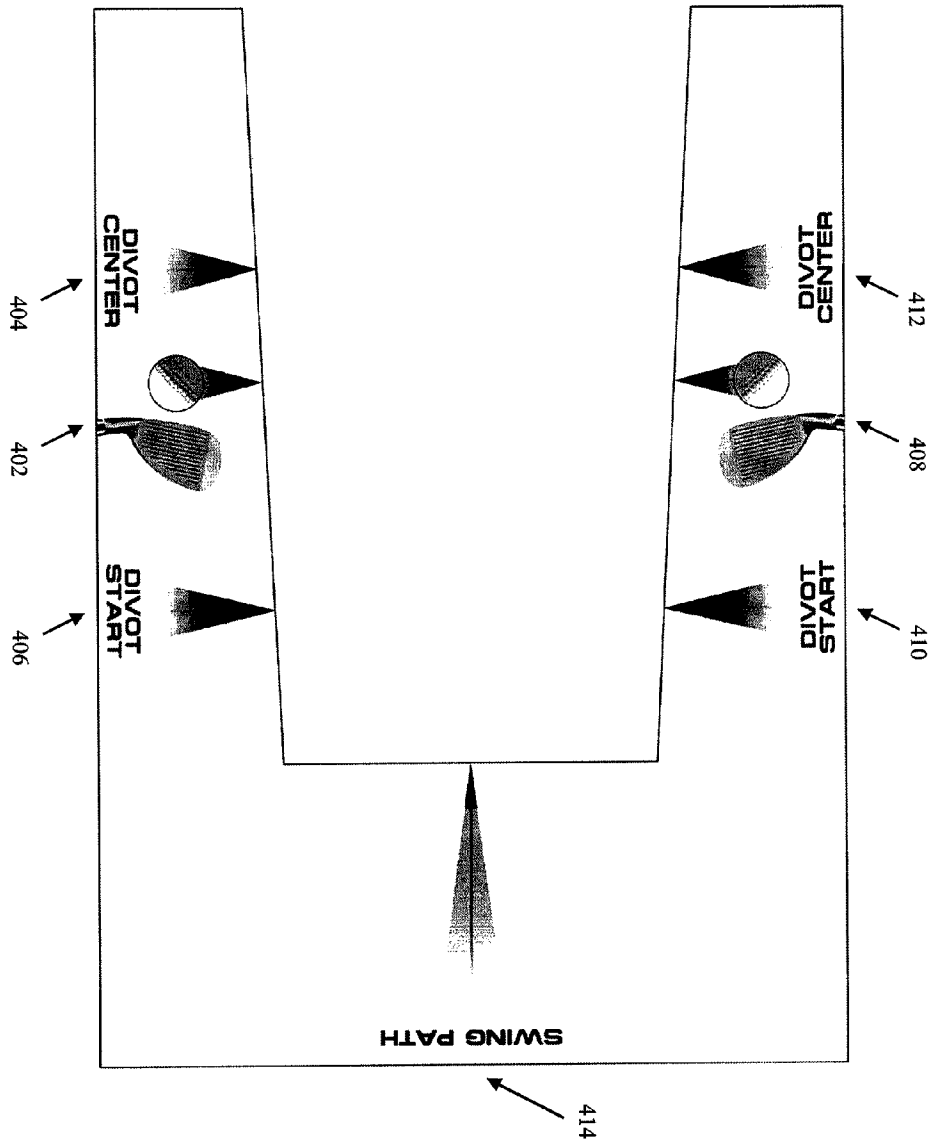
FIG. 8 a top view of a seventh embodiment of a device in accordance with the present disclosure

FIG. 8 shows an additional embodiment similar to the embodiment shown in FIG. 5 for use in greenside bunkers. This embodiment also includes a cut-section with non-parallel sides. A first set of markings 402, 404, 406 are provided for use by right handed players. Marking 402 indicates proper ball placement and club head orientation. Markings 406 and 404 indicate the beginning and center of a preferred divot, respectively, when hitting a ball from a greenside bunker. A second set of markings 408, 410 and 412 are mirror images of markings 402, 406, 404 for use by left handed users. A third set of markings 414, indicates the swing path and direction using an arrow and a gradient background.

The markings are meant as a guide for the user and in reality represent points along a spectrum of possibilities. For example, referring back to FIG. 1, the user can place the ball centered vertically in the cutout 16 at any distance from the rear edge 30 of the device. Lower numbered clubs (low irons and fairway woods) require more space between the ball and rear of the device due to the shallower swing angles. Additionally the difficulty level of the shot can be increased by placing the ball closer to the rear of the device.

Having described the structure of the device, its usage is now discussed in detail. For straight shots the device 2 is initially placed on the playing surface with the middle arrow of markings 24 pointed at the intended target. The playing surface can be any type of appropriate material for golf play or teaching, including a floor, rug, grass, artificial turf golf mat, sand, dirt, concrete or other suitable surface material or composition. Then the ball is placed in the cut out 16 such that it is generally centered between right side section 8 and left side section 10. One ball placement is shown by 40 in FIG. 3. The user chooses the distance between the ball and the rear edge 30 of the device based on the intended club and desired degree of difficulty. The device may include markings such as 20, 22, 26, 27, 28 and 29 in FIG. 2 or 64 in FIG. 4 which suggests ball positions based on the intended club and/or desired degree of difficulty.

Figure 3:
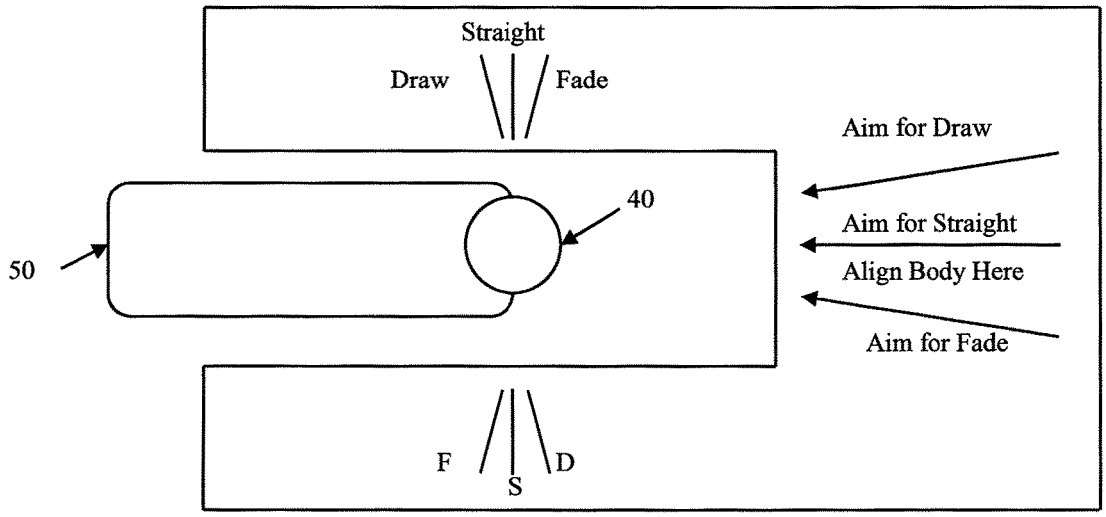
FIG. 3 is a top view showing a ball position and a proper divot.

With the device and ball in place, the user then assumes his or her preferred stance and addresses the ball with the club head parallel to the "Straight" and "S" lines. The user then swings the club and hits the ball ideally without hitting the device 2. As discussed above, the club head should contact the ball on the downswing. After hitting the ball, the club head should make contact with the surface either directly under or immediately in front of ball's original position. If the device is being used on grass or sand an ideal shot will result in a 6"-8" rectangular divot that begins under the ball and continues forward. FIG. 3 shows an original ball position 40 and a proper divot 50 which should result if a ball placed at original ball position 40 is hit correctly. When hitting off a mat, for example, there will not be a divot but the club head should initially contact the mat either directly under or immediately in front of the ball's original position, and should not come off of the mat until 6"-8" after initial contact.

The procedure for hitting draw and fade shots is now described. Similar to straight shots, the device is placed on the playing surface but here either the "Aim for Draw" or "Aim for Fade" arrow is pointed at the intended target depending upon the desired shot. This means the device 2 will be angled relative to the intended target. Then just as with straight shots the ball is placed dependent upon the club type to be used and the desired difficulty level. Then the user assumes a preferred stance with his or her body aligned to the middle arrow and addresses the ball with the club head parallel to the corresponding set of lines. In other words, the club head will either be parallel to the "Draw" and "D" angled lines or the "Fade" and "F" angled lines based on the desired shot. The user then swings the club just as they would if they were hitting a straight shot.

The procedure for hitting a greenside bunker shot using the markings shown in FIG. 5 is very similar to the fade shot procedure discussed above. First the device is placed on the playing surface (in this case the sand of the bunker) such that arrow 109 is pointed at the intended target. Then the ball is positioned centered between vertical lines 115. Then the user assumes a preferred stance with his or her body aligned to arrow 105 and addresses the ball with the clubface parallel to the open clubface reference line 113. Next the user swings the club in line with arrow 105 as discussed previously. The difference between the bunker shot and the previously discussed shots of FIGS. 1-4 is that the club head should enter the sand at the sand entry line 111 and the bottom of the swing arc should be located between line 115 directly below the ball and a point a couple of inches in front of the ball. The bottom of the swing arc may be at different points for different players. Technically this is a fat shot, as discussed previously, but this is desirable when hitting from a greenside bunker as it lifts the sand along with the ball imparting a gentle and controlled lifting action on the ball without creating too much speed.

It is important to note that the path of the club head is the same for all shots. The club head should travel through the cut out 16 (FIG. 1) hitting the ball without contacting the device for straight, draw, greenside bunker and fade shots. The difference between a draw or fade shot and a straight shot is the alignment of the club head relative to the swing path. The angled orientation of the club head relative to the swing path imparts spin on the ball. Thus for draw and fade shots the ball initially travels in a line between the club face angle and the club path angle (to the right or left of the intended target) but the spin of the ball causes it to eventually curve to the right or left back towards the intended target.

The device provides instant feedback to the user through sound, feel, movement (if any, of the golf teaching tool), and ball flight. To hit the ideal shot with proper ball impact it is necessary to hit the ball without hitting the device. If the club contacts the device the user will both hear the sound made from the metal club head striking the device and feel the impact. As discussed below, the contact may also move the device providing additional feedback to the user as to what happened.

If the bottom of a swing is located behind the ball, meaning a fat shot, the player will hit the device. The sound and feel of the impact tells the user that the bottom of a swing arc was located behind the ball and he or she can adjust accordingly. Generally this sort of contact with the device will cause minimal movement as it is primarily a downward strike of the club head onto the top surface of the device 2, such as surface 1 for right-handed golfers. A divot that starts behind the ball's original position is also indicative of this sort of error. Ideally the user should be able to hit the ball and take a divot after the ball without ever touching the device (as shown in FIG. 3). Thus the perfect shot would result in no contact with the device and a divot that begins under the placed ball and continues forward from the placed ball for 6"-8". Additionally if the player hits the ball without hitting the device but fails to leave a divot or contact the mat with the club the user will know they hit a thin shot and that the bottom of the swing arc needs to be adjusted accordingly.

If the toe of the club contacts the ball, the heel of the club will hit the inside edge of the cutout 16 (closest to the player), pushing the device closer to the player. This movement of the device towards the player, along with the sound and feel of the impact, tells the user that the heel of the club struck the device. Conversely, if the heel of the club makes contact with the ball, the toe of the club will hit the outside edge of the cutout 16 (farthest from the player) pushing the device away from the player. Once again the combination of movement, sound, and feel will tell the player what was improper about the swing.

In order to miss the device and hit the ball solidly, creating maximum ball speed, the club shaft must be leaning forward (the handle should be closer to the target than the club head), and the club head must be descending as it makes contact with the golf ball. This de-lofts the club head and compresses the golf ball, producing a lower trajectory, higher ball speed, and more penetrating ball flight.

The device can be used to provide golf instruction in a number of ways. In one instance, the device can be utilized directly by a user with the aid of written or video instructions. In another instance, an instructor can work with the user either individually or in a group, to provide in person instruction on the use of the device as part of a golf lesson or other teaching opportunity. Thus the device can be used with or without the aid of a professional instructor.

By repeatedly hitting balls with the device the user learns to adjust his or her swing to properly impact the ball, leaving the preferred divot, without contacting any portion of the device 2. Then the user can replicate his or her techniques on the golf course to produce proper ball impact and better shots even when the device is not present.

What is claimed is:

1. A teaching tool for airborne shots comprising:

a rectangular portion having a cutout adapted for placement of a ball inside the cutout, the cutout defining:

a first side section and a second side section connected by a rear section;

a set of side markings on a top surface of either the first side section and/or the second side section, wherein the side markings generally reference at least placement of a ball and club orientation; and a set of rear markings on a top surface of the rear section, and generally pointing towards the cutout, having one straight marking and at least one angled marking for a fade or draw shot, wherein the teaching tool is adapted to be rotated such that each marking is adapted to generally point at a different angle towards an intended target depending on which airborne shot is desired.

2. The teaching tool of claim 1, wherein the side markings are labeled with letters D, S, and F and the rear markings are labeled with draw, straight, and fade and indicate direction and speed of the club.

3. The teaching tool of claim 1, wherein the side markings are labeled with a plurality of illustrations of club heads such that the illustrations of club heads indicates a plurality of golf ball placement locations within the cutout corresponding to different club types.

4. The teaching tool of claim 1, further comprising:

a second set of side markings on a bottom surface of either the first side section or the second side section; and a second set of rear markings on a bottom surface of the rear section.

5. A golf training method comprising:

providing a golf teaching tool, wherein the golf teaching tool comprises a rectangular portion having a beveled cutout section and at least one marking for a draw or a fade shot, the rectangular portion comprising at least one of impact resistant material;

placing the golf teaching tool on a playing surface, rotating the golf teaching tool such that the at least one marking for a draw or a fade shot in a rear section of the rectangular portion faces an intended target when a draw or a fade shot is desired;

positioning a golf ball within the cutout section of the golf teaching tool;

positioning the head of a golf club such that it is aligned with the at least one marking for a draw or a fade shot on the golf teaching tool;

swinging the golf club in the direction of the golf ball and along an angle marking at least a draw or a fade shot of the golf teaching tool;

listening for or feeling contact between the head of the golf club and the golf teaching tool; and determining by movement of the golf teaching tool or by location of the impact point whether the golf club head contacted the beveled cutout portion of the golf teaching tool indicating that the draw/fade shot would therefore be off-angle relative to the intended target.

6. The teaching tool of claim 1, wherein the rectangular portion has a length between 8 inches and 24 inches, a width between 6 inches and 20 inches, and a thickness between ⅛ inch and ½ inch.

7. The golf training method of claim 5, wherein the at least one marking, further comprises a marking for a straight or shot.

8. The golf training method of claim 5, wherein the at least one marking for a draw or a fade shot comprises a plurality of illustrations of club heads indicating different club types.

9. The golf training method of claim 8, wherein the positioning the golf ball step includes positioning the golf ball within the cutout section of the golf teaching tool based on one of the markings indicating different club types.

10. The golf training method of claim 5, wherein the cutout section further defines a first side section and a second side section which are connected by the rear section of the rectangular portion.

11. The golf training method of claim 10 further comprising determining that the club head made contact with the rear section indicating improper swing position.

12. The teaching tool of claim 1 further comprising an open end located opposite to the rear section, wherein the open end is longer than an interior edge of the rear section such that an interior edge of the first side section is not parallel to an interior edge of the second side section.

* * * * *